US008650666B2

(12) United States Patent
Crutcher

(10) Patent No.: US 8,650,666 B2
(45) Date of Patent: Feb. 18, 2014

(54) HEADGEAR ATTACHMENT FOR PORTABLE AUDIO DEVICE

(71) Applicant: William C. Crutcher, Middlebury, CT (US)

(72) Inventor: William C. Crutcher, Middlebury, CT (US)

( * ) Notice: Subject to any disclaimer, the term of this patent is extended or adjusted under 35 U.S.C. 154(b) by 0 days.

(21) Appl. No.: 13/726,056

(22) Filed: Dec. 22, 2012

(65) Prior Publication Data

US 2013/0160187 A1 Jun. 27, 2013

Related U.S. Application Data

(60) Provisional application No. 61/580,294, filed on Dec. 26, 2011.

(51) Int. Cl.
*A42B 1/24* (2006.01)

(52) U.S. Cl.
USPC ..... 2/209.13; 2/173.5; 2/253

(58) Field of Classification Search
USPC ..... 2/209.13, 247, 250–253; 455/344, 351, 455/575.3; 381/301, 309, 333, 376, 385, 381/388
See application file for complete search history.

(56) References Cited

U.S. PATENT DOCUMENTS 5,410,746 A * 4/1995 Gelber ..... 455/344
5,581,821 A * 12/1996 Nakano ..... 2/422
5,615,415 A 4/1997 Beckerman
5,625,903 A * 5/1997 Schultz et al. ..... 2/209
5,715,540 A 2/1998 Cho
5,881,390 A * 3/1999 Young ..... 2/209.13
5,966,742 A 10/1999 Cunliffe
6,016,572 A 1/2000 Park
6,339,844 B1 1/2002 Merkley
6,493,880 B1 12/2002 Lo
6,625,818 B2 9/2003 Putnam
D503,261 S 3/2005 Pedersen
7,127,746 B2 10/2006 Park
7,364,491 B2 * 4/2008 Updyke ..... 450/89
7,702,122 B2 4/2010 Crutcher
7,814,573 B1 10/2010 Greenberg
7,862,194 B2 * 1/2011 Seade ..... 362/106
7,974,432 B1 7/2011 Ryan
8,009,847 B2 * 8/2011 Planansky ..... 381/301

(Continued)

*Primary Examiner* — Khoa Huynh
*Assistant Examiner* — Sally Haden

(57) ABSTRACT

A baseball type cap with a circumferentially stretchable headband to adjust to different head sizes is modified to add a stretchable fabric member that is stitched to the cap cover gores and to the stretchable headband. The lower edge of the fabric member extends about halfway around the back of the cap ending on either side near the ears of a user wearing the cap and stretches along with the stretchable headband to adjust to the head size of the user. A number of seams join the stretchable fabric member to the cap cover, creating a center pocket with an open top to hold a stereo jack and a removable audio device such as an MP3 player. The seams also create bud pockets on either side to hold ear buds. The dual wires from the stereo jack lead to a T-junction in the bottom of the center pocket and are long enough to manipulate the controls of the MP3 player outside the pocket while wearing the cap. At the T-junction, the dual wires are divided into individual ear bud wires, which pass through passages between the seams from the center pocket to the bud pockets without need to pierce the cap cover or fabric member. At the opposite ends of the fabric member on the sides of the cap, the seams are interrupted to leave openings for withdrawing the ear buds for use and subsequently replacing them.

2 Claims, 8 Drawing Sheets

(56) References Cited

U.S. PATENT DOCUMENTS

Figure 1:
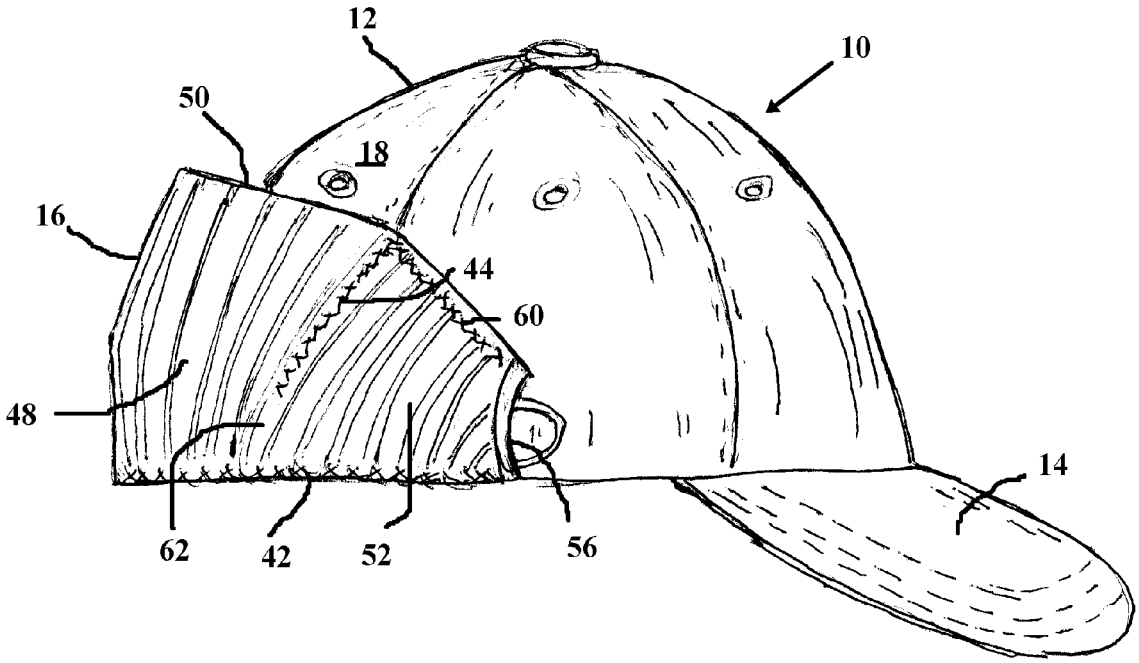

| | | | | |
|---|---|---|---|---|
| 8,189,844 | B2 * | 5/2012 | Dolberg | 381/376 |
| 8,316,467 | B2 * | 11/2012 | Foust et al. | 2/209.13 |
| 2006/0185062 | A1 * | 8/2006 | Peng et al. | 2/209.13 |
| 2006/0251283 | A1 | 11/2006 | Yeh | |
| 2007/0130669 | A1 | 6/2007 | Rogers | |
| 2007/0226876 | A1 | 10/2007 | Foust | |
| 2008/0044052 | A1 | 2/2008 | Whipple | |
| 2009/0175482 | A1 * | 7/2009 | Crutcher | 381/376 |
| 2009/0180658 | A1 | 7/2009 | Dolberg | |
| 2009/0210995 | A1 * | 8/2009 | Kwon et al. | 2/209.13 |
| 2010/0329499 | A1 * | 12/2010 | Wolfe | 381/376 |

* cited by examiner

HEADGEAR ATTACHMENT FOR PORTABLE AUDIO DEVICE

CROSS REFERENCE TO RELATED APPLICATIONS

This application claims the benefit of prior filed co-pending provisional application Ser. No. 61/580,294 filed Dec. 26, 2011.

TECHNICAL FIELD AND INDUSTRIAL APPLICABILITY OF THE INVENTION

This invention relates to an improvement in a headgear attachment for docking and listening to portable audio devices while wearing the headgear, of the type exemplified and described in my U.S. Pat. No. 7,702,122 issued Apr. 20, 2010, said patent being incorporated herein by reference.

BACKGROUND OF THE INVENTION

Portable audio devices include AM and FM radios, audio tape players, and digital audio players such as iPod and MP3 players. The audio devices are usually transported by carrying in the hand or in a pocket, or attaching them to a belt, or by strapping them to the arm.

Many users prefer an audio device with a plug-in jack attached to an electrical cord running to ear buds. Where the audio device is equipped for stereo sound, one earphone and one branch segment of the connection cord is used for each stereo track, and merge at a junction into a common twin wired segment connected to a stereo plug-in jack.

The presence of the electrical cord is a great annoyance, because movement of the head with respect to the body of the user when the audio device is pocketed or strapped in place causes the cord to intermittently contact the face or neck. Turning the head tightens one of the branch cords which can pull out one ear bud. Also the weight of the cord or catching of the cord in clothing or on external objects causes pulling against the connector jack or the audio device, which can cause both of the ear buds to become dislodged. This is disconcerting because it interrupts listening to the music or book as the audio device continues to run while the ear buds are being repositioned.

Another annoyance is that movement of the wires against the face or clothing can create noise or static which is heard in the ear buds along with the audio program, degrading the listening experience.

U.S. Pat. No. 7,974,432, issued Jul. 5, 2011 to Patrick T. Ryan discloses a baseball styled cap that retains an elasticized sleeve on the inside, front wall of the cap. A portable audio player or radio can be inserted into the sleeve and connected to a pre-installed wiring and speaker system that is integrated into the fabric seams of the cap. This unitary configuration allows the cap with audio system to be worn and used in comfort, with little or no limitation on the physical activity of the wearer. An audio device within an elasticized sleeve in the front of the cap above the brim is connected to the speaker system. Two ear buds hang from the opposite sides of the cap with no convenient means shown to store them when the audio device is not in use except to tuck them into the headband of the cap.

My aforementioned U.S. Pat. No. 7,702,122 solved these problems as described briefly in its abstract, as follows: "A cap for listening to an audio device such as an MP3 player or iPod has a pocket in the back with a spring-loaded double-ended retractor for pulling a stereo jack to the front of the cap for connecting to an audio device, adjusting it and returning the retractor along with the audio device to the pocket. The stereo jack is connected to ear buds via wires leading from a T-shaped anchoring junction secured in the bottom of the pocket. The ear buds hang from opposite sides of the cap and are placed in bud pockets on the cap when not in use."

Figure 2:
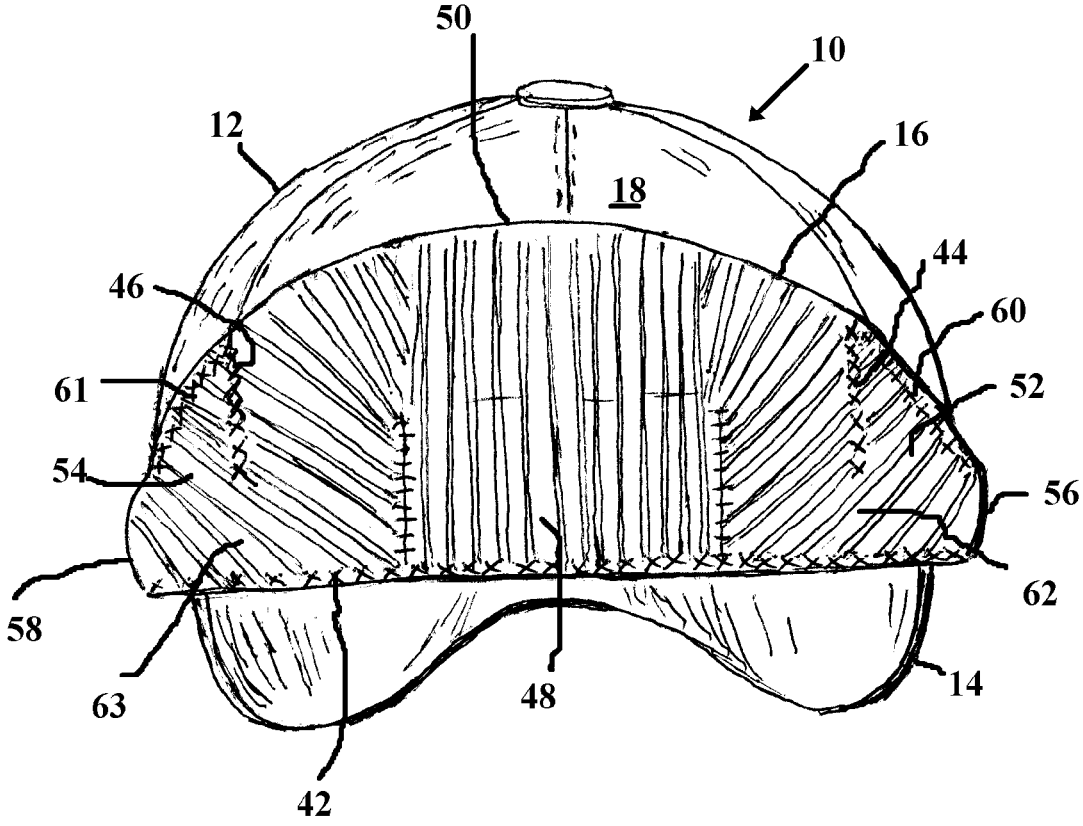

In one version of the invention, as shown in FIGS. 1 and 2, along with the accompanying description in paragraphs 0036 and 0037 the wires from the anchoring junction to the ear buds pass through an aperture to the inside of the cap cover and along the headband to exit from opposed apertures below the headband, and then back to exterior ear bud pockets formed between the cap cover and a fabric member stitched thereto.

Figure 9:
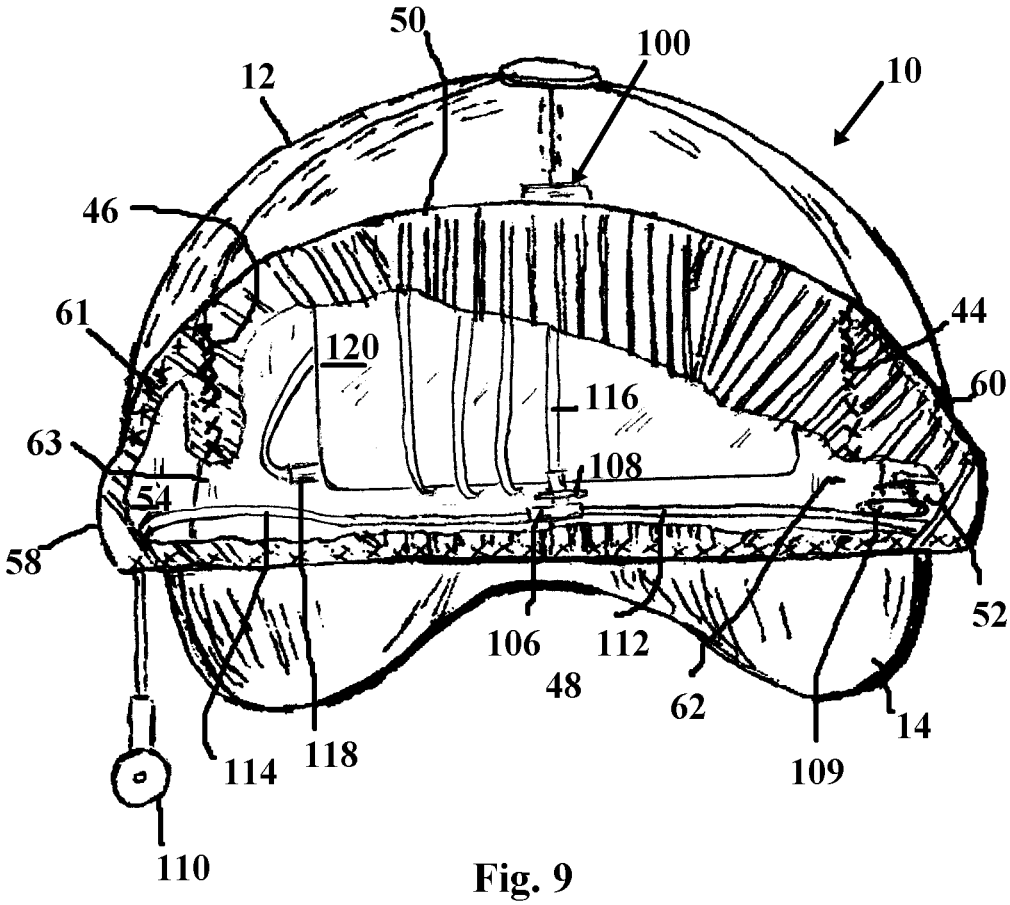

In another version of the invention, as shown in FIGS. 9 and 10 along with the accompanying description in paragraphs 0045 and 0046, a stretchable fabric member is stitched to the cap cover to provide a pocket for the audio device. Separate exterior bud pockets are sewn to the cap cover to receive ear buds exiting from apertures below the headband as before.

The foregoing patent constructions complicate the assembly and placement of the wires between the anchoring junction and the ear buds, since they require apertures through the cap cover to bring the ear buds from the outer side to the inner side and back out again with additional sewing around the apertures. Also, a greater length of wire is required and there is the possibility of interference between the wires and the headband, especially in the case of a stretchable headband. Since the wires are inside the cap cover, it is necessary to hide or cover them within the headband to prevent them from catching on objects.

Accordingly, one object of the present invention is to provide a simplified headgear attachment for docking and listening to portable audio devices while wearing the headgear.

Another object of the invention is to provide an improved construction for integrating an audio device carrying pocket with ear bud pockets beneath a single fabric member attached to the cover of headgear.

Still another object of the invention is to provide an improved construction for integrating an audio device carrying pocket communicating with ear bud pockets inside a laterally stretchable fabric member attached to a circumferentially stretchable headband on a cap.

A more specific object of the invention is to provide a laterally stretchable fabric member that may be attached to a circumferentially stretchable headband on a cap in a simplified construction to provide an audio device carrying pocket communicating with ear bud pockets.

SUMMARY OF THE INVENTION

Briefly stated, the invention comprises the combination of headgear with an attachment adapted for docking and listening to a portable audio device that is selectively connectable to a pair of ear buds integrated with the headgear. The headgear comprises a cap cover connected to a circumferentially stretchable headband. The headgear attachment comprises a uniaxially stretchable fabric member that covers a back portion of the cap cover. The fabric member has a lower edge extending along the axis of stretch that is sewn to the headband at the rear of the headgear by a headband seam connecting the lower edge of the fabric member to the circumferentially stretchable headband. First and second spaced vertical pocket seams attach the fabric member to the cap cover to define there between a center pocket with a top opening, and first and second bud pockets with opposed side openings disposed respectively on either side of the center pocket. The first pocket seam is separated from the headband seam to define a first passage between the first bud pocket and the center pocket. Similarly, the second pocket seam is separated from the headband seam to define a second passage between the second bud pocket and the center pocket. The first and second passages provide for wiring necessary to connect the ear buds to the audio device. The headgear attachment is adapted to receive and hold an easily removable audio device in the center pocket when the audio device is in use and to hold the first and second ear buds in the first and second bud pockets respectively when the audio device is not in use.

DRAWING

Figure 3:
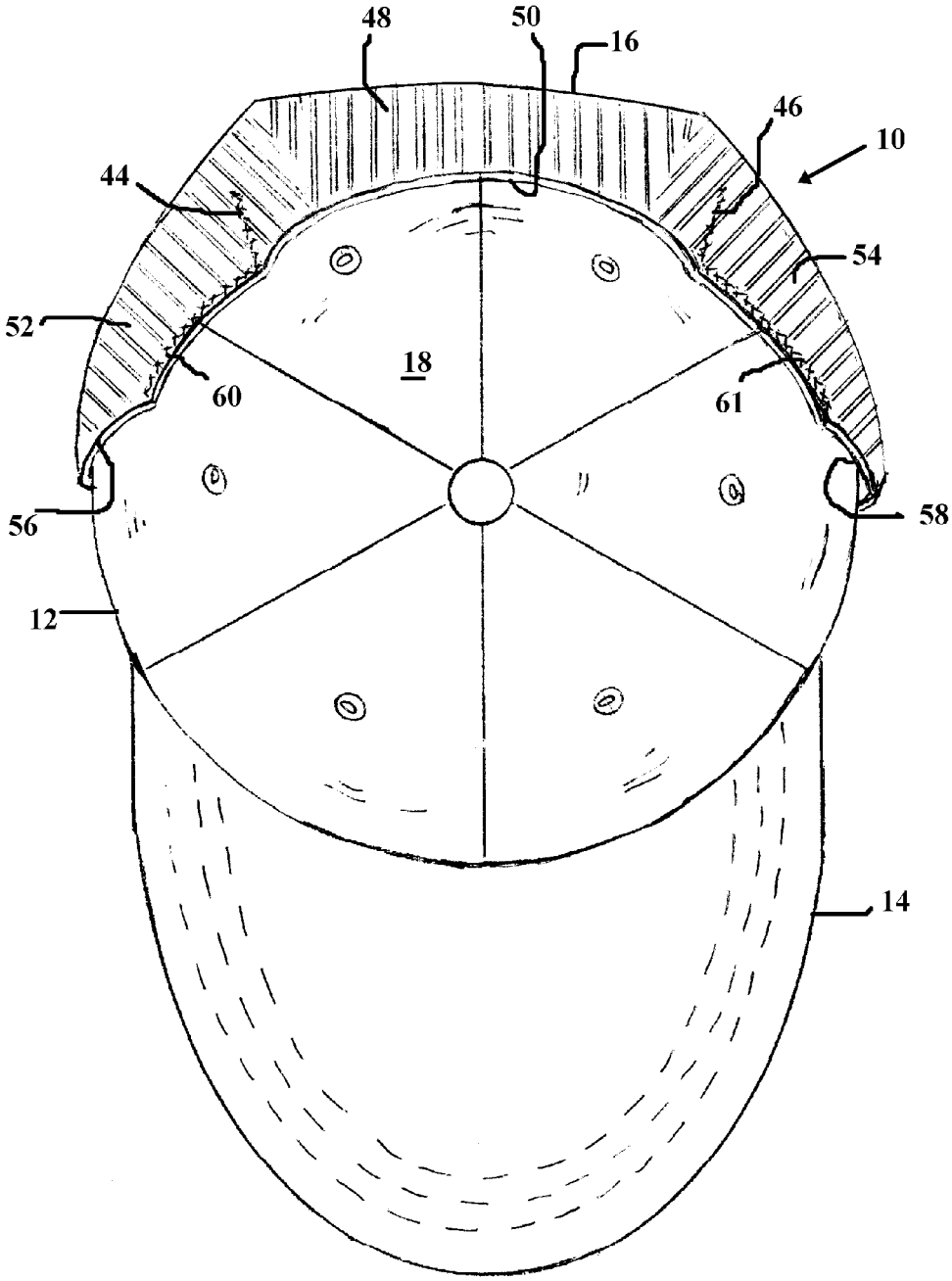
Figure 4:
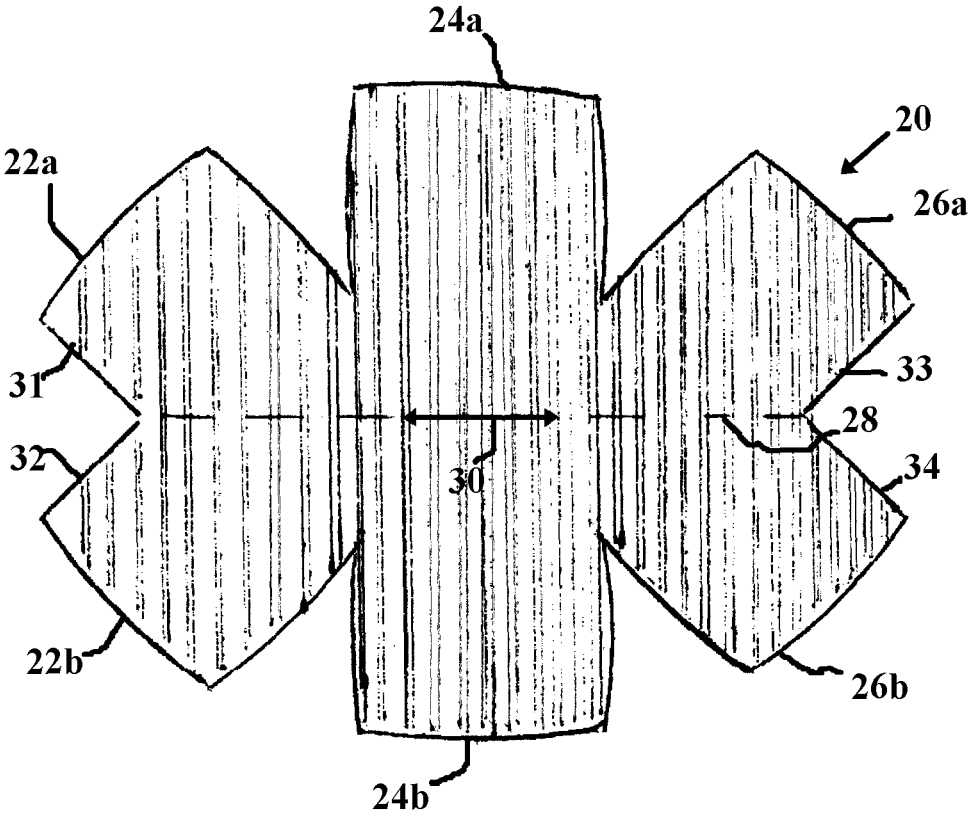
Figure 5:
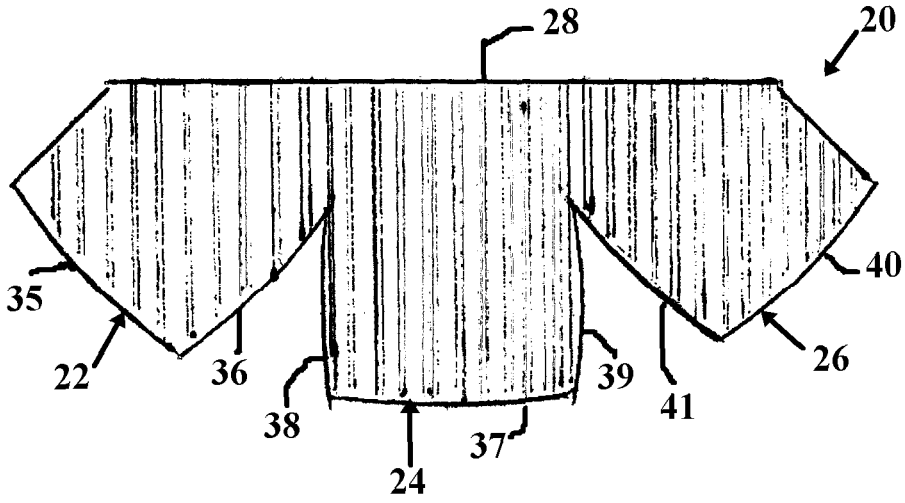
Figure 6:
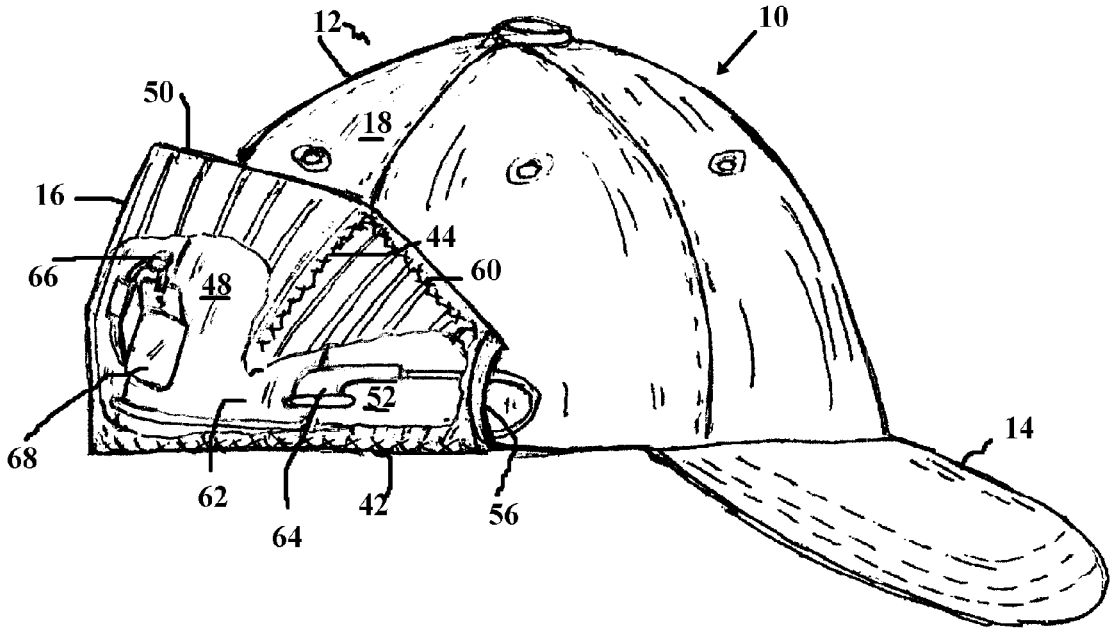
Figure 7:
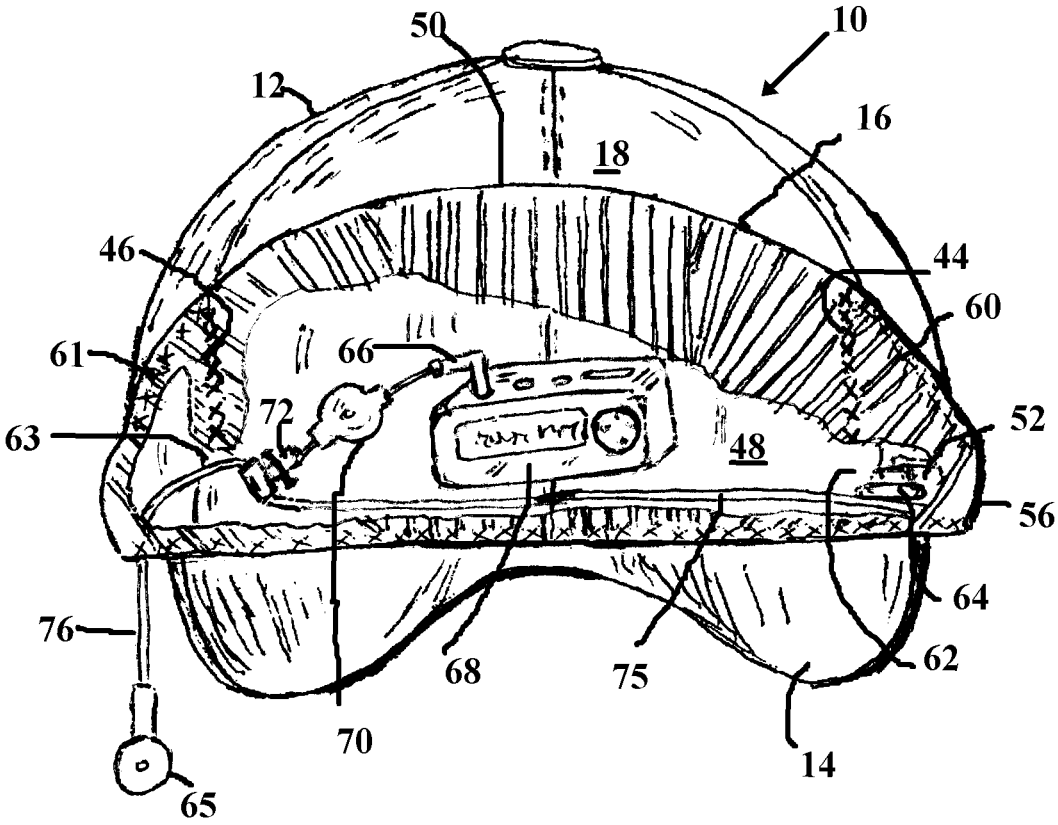
Figure 8:
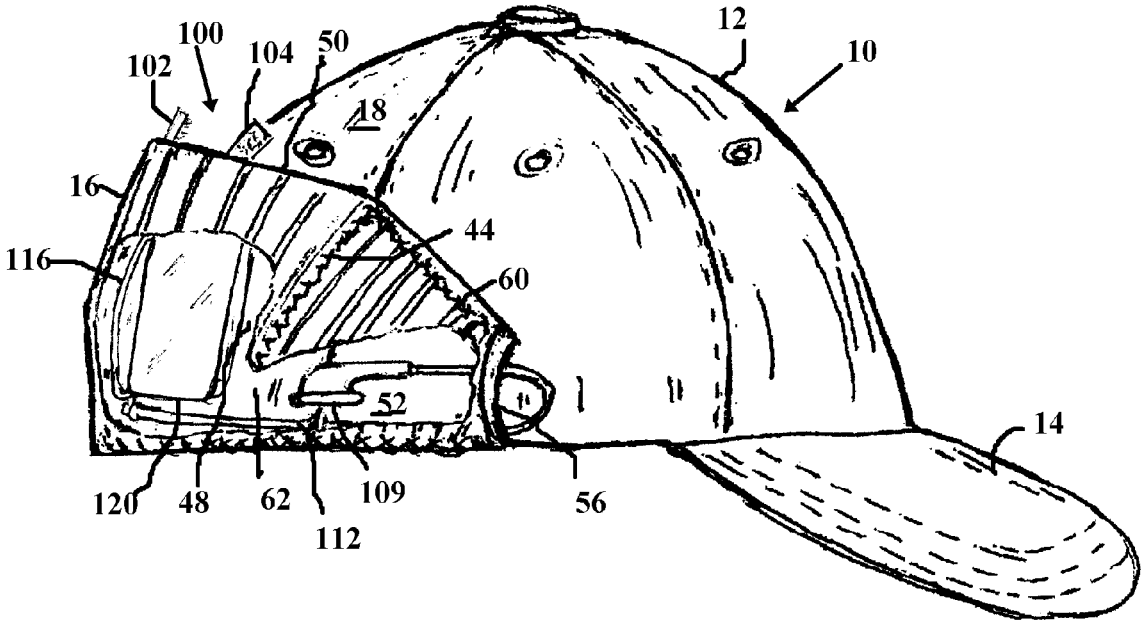

The invention will be better understood by reference to the following description, taken in connection with the accompanying drawing, in which:

FIG. 1 is a right side elevation view of a headgear with an attached stretchable fabric member forming a pocket for an audio device and with an ear bud stowed in the pocket, FIG. 2 is a rear elevation view of the headgear and attached stretchable fabric member, FIG. 3 is a top plan view of the headgear and attached stretchable fabric member, FIG. 4 is a plan view of a pattern for a single layer of the stretchable fabric member, FIG. 5 is a plan view of the stretchable fabric member pattern folded into a double layer, FIG. 6 is a side elevation view of a headgear with an attached stretchable fabric member forming a pocket and cut away in part to show an audio device and with ear buds stowed, FIG. 7 is a rear elevation view of the headgear with attached stretchable fabric member cut away in part to show the audio device connected to ear buds and means of holding it in place, FIG. 8 is a side elevation view of a modification of the invention, showing a headgear with an attached stretchable fabric member forming a pocket and cut away in part to show another type of audio device and with ear buds stowed, and FIG. 9 is a rear elevation view of the headgear of FIG. 8 with attached stretchable fabric member cut away in part to show the other type of audio device connected to ear buds and a different means of holding it in place.

DESCRIPTION OF THE PREFERRED EMBODIMENT

Referring now to FIG. 1 of the drawing, a side elevation view is shown of a headgear constructed in accordance with the invention in the form of a cap 10 having a cap cover 12, a sun visor 14 and a stretchable fabric member 16, which is the object of the present invention, attached to the rear of the cap. FIG. 2 is a rear elevation view and FIG. 3 is a plan view of cap 10.

The construction of the above main elements of cap 10 will vary greatly with the quality and type of the cap. Usually, the cap cover is made up of fabric panels or "gores" roughly triangular in shape, but with arcuate sides, such as a panel 18. The panels, usually five or six in number, are sewn together along the edges and intersect at a common apex covered by a button. Cap 10 is of the type sometimes known as "one-size-fits-most" or "free-size" so as to be circumferentially stretchable by virtue of having elastic elements used in its construction. The term "circumferentially stretchable" as used in this application means that when the headgear is placed on heads of different sizes the elements making up the head gear, such as the cap cover panels or the connections between panels or the headband, whether segmented or unitary, will combine to allow the headgear to stretch in a circumferential direction. This serves to adjust the overall circumferential measurement of the headgear in the vicinity of the headband so as to comfortably fit the head of the user.

A number of exemplary patents and published patent applications cited below will illustrate various ways of achieving a circumferentially stretchable cap 10. The preferred embodiment of the present invention does not require any specific type of construction shown in these exemplary patents, except that the cap be circumferentially stretchable.

| App./Pat. No. | Pub./Issue. Date | Inventor | Title |
|---|---|---|---|
| 5,615,415 | Apr. 1, 1997 | Beckerman | Custom Fit Cap |
| 5,715,540 | Feb. 10, 1998 | Cho | Free-Size Cap |
| 5,966,742 | Oct. 19, 1999 | Cunliffe | Adjustable Cap |
| 6,339,844 | Jan. 22, 2002 | Merkley | Peaked Cap |
| 6,493,880 | Dec. 17, 2002 | Lo | Adjustable Headware |
| 6,625,818 | Sep. 30, 2003 | Putnam | Cap with Biaxial Headband and Other Adjustable Headgear |
| 7,127,746 | Oct. 31, 2006 | Park | Pressure Resolving Cap and Headband Thereof |
| 7,814,573 | Oct. 19, 2010 | Greenberg | Self-Sizing Cap with Diverse Headband Segments |
| 2007/0130669 | Jun. 14, 2007 | Rogers | Hat with Multi-Stretchable Headband |
| 6,016,572 | Jan. 25, 2000 | Park | Free-Size Cap |

In accordance with the present invention, the stretchable fabric member 16 is adapted to receive and hold an audio device selectively attachable to a pair of ear buds by an audio jack. Reference to FIGS. 4 and 5 shows a preferred manner of making the fabric member 16 illustrated in FIGS. 1, 2 and 3.

FIG. 4 illustrates a pattern 20 cut from a single layer of a uniaxially stretchable, woven fabric member. A preferred material is a "rib knit" woven material of 95% cotton and 5% Spandex. Another suitable material is a ribbed woven material of 97% cotton and 3% Spandex. FIG. 4 shows the direction of spaced ribs 21 that add body to the material. The pattern consists of three upper lobes 22*a*, 24*a*, 26*a* that are identical in shape and size to lower lobes 22*b*, 24*b*, 26*b* disposed in mirror image about a fold line shown by dotted line 28.

The material is woven such that it is uniaxially stretchable in a direction perpendicular to ribs 21. Therefore it is important to note that the pattern is oriented and the material is cut so that that the fabric is uniaxially stretchable in the direction along dotted line 28, i.e. as shown by double ended arrow line 30.

In order to prepare hems for the entries to the bud pockets, the fabric is folded in half along the fold line 28. The matching outermost edges 31, 32 of lobes 22*a* and 22*b* are sewn together and the matching outermost edges 33, 34 of lobes 26*a* and 26*b* are sewn together. Then the fabric is turned inside out, whereupon it appears as shown in FIG. 5.

FIG. 5 shows the pattern folded about the fold line 28 to form a double layer of stretchable fabric, designated by reference number 20 in FIG. 5.

Lobes 22*a* and 22*b* match to form a double layer lobe 22. Similarly, lobes 24*a* and 24*b* match to form a double layer lobe 24 and lobes 26*a* and 26*b* match to form a double layer lobe 26. An end 35 and one side 36 of lobe 22 are arcuate. An end 37 and opposed sides 38, 39 of lobe 24 are arcuate, and an end 40 and one side 41 of lobe 26 are arcuate.

Next, the fabric member is prepared for attaching to the cap 10. Arcuate sides 36, 38 are sewn together and arcuate sides 39, 41 are sewn together. This causes the double sided fabric member to assume a three dimensional shape, with the arcuate edges 35, 37 and 40 of lobes 22, 24 and 26 forming a continuous arcuate lower edge. This step shapes the fabric member into the shape shown as the stretchable fabric member 16 illustrated in FIGS. 1, 2 and 3 for attaching to cap 10.

While the above described process uses a single layer of fabric doubled to construct the stretchable fabric member 16, an alternate acceptable method may use a single layer and a pattern cut from a heavier piece of uniaxially stretchable fabric (not shown). In this case the pattern would appear as shown in FIG. 5. The steps in the preceding paragraph would be followed in the same way to sew together the arcuate edges so as to shape the fabric member for attachment to the cap. However, additional finishing hems would be required along rough cut edges which are not required using the preferred double layer process.

Lastly, the fabric member 16 is attached to the cap by sewing the lower edge to the cap cover or the headband with a headband seam indicated at 42 in FIGS. 1 and 2. The fabric member is then attached to the cap cover by two spaced pocket seams 44, 46 each extending from the fold line 28 toward, but stopping short of the headband seam 42. As best seen in FIG. 2, pocket seams 44, 46 serve to divide the space between the fabric member 16 and the cap cover 12 into a center pocket 48 with a bottom provided by headband seam 42 and having a top opening 50 and first and second bud pockets 52, 54 with opposed side openings 56, 58 disposed respectively on either side of the center pocket 48. The tops of the bud pockets are closed by two side seams 60, 61 running along the fold line 28 and attaching the fabric member 16 to the cap cover 12, leaving the center section along the fold line 28 of the fabric member unattached to the cap cover. As best seen in the plan view of FIG. 3, side seam 60 extends from pocket seam 44 to the bud pocket opening 56 and side seam 61 extends from pocket seam 46 to the bud pocket opening 58.

Referring to FIG. 2, it is seen that center pocket 48 communicates with bud pocket 52 by a passage 62 between the end of pocket seam 44 and the headband seam 42. Similarly, center pocket 48 communicates with bud pocket 54 by a passage 63 between the end of pocket seam 46 and the headband seam 42. The passages 62, 63 are just large enough to force ear buds through them from the center pocket 48 into the bud pockets 52, 54 during installation, but are not large enough to allow an audio device in the center pocket to go through them.

Operation

Referring to FIGS. 6 and 7 the cap 10 is provided with a built-in set of ear buds 64, 65 connected to a stereo jack 66 for listening to an audio device 68 that may be carried in pocket 48 when the cap is in place. The device 68 is easily accessible through the top opening 50 of the center pocket to remove the device for wearing the cap in ordinary fashion without it. However, in a preferred form of the invention, the stereo cord is collected in a double-ended spring loaded retractor 70. The retractor 70 is seen in the pocket 48 by removing a portion of fabric member 16 as shown in FIG. 7. Retractor 70 is secured with a T-junction 72 in the bottom of pocket 32. The T-junction is secured to the cap cover by any suitable means such as a cord tie. The T-junction is preferably anchored to one side at the bottom of center pocket 48 to allow more room for the audio device 68 and retractor 70. The retractor is spring loaded and, together with the usual firm connection between stereo jack 66 and the audio device, serves to retain the audio device securely in center pocket 48 without need for additional closure pieces at the open top 50 of the center pocket 48, although these can be added if desired.

The leads from the T-junction 72 to the ear buds 64, 65 are shown at 75, 76 respectively. They connect directly to the ear buds through the passages 62, 63 without the need for apertures either in the cap cover 12 or in the fabric member 16. Thus the wires are not exposed inside the cap cover or headband where they might become damaged. The ear buds may either be placed in the pockets or pulled out for inserting in the ears as shown in two alternate positions in FIG. 7. In case of a malfunction in the ear bud set, it may easily be replaced by removing the securing cord tie and pulling the ear buds out through passages 62, 63.

Modification

Referring to FIGS. 8 and 9 of the drawing a modification is shown which is adapted to carrying an audio device without the need for a spring loaded retractor. In the drawings the cap and fabric member are shown with the same reference numbers as in FIGS. 1-3 for the elements which are identical to those previously discussed. The new elements are shown with new reference numbers commencing with 100. There is no spring loaded retractor to hold the audio device in the center pocket 48, but in order to achieve accessibility to adjust the device while the ear buds are inserted in the ears, an ample length of wire is provided to connect the stereo jack to the T-junction. The fabric member 16 has been cut away in the drawings to more clearly describe the construction.

A closure member 100 for the open top 50 of the center pocket 48 is shown generally at 100. In a preferred embodiment of the modification, the closure member is a Velcro (or fabric hook-and-eyelet pair) comprising a hook covered fabric 102 attached by stitching or adhesive to the fabric member 16 and an eyelet covered fabric 104 attached by stitching or adhesive to the cap cover 12. One such closure member is generally sufficient, but two or three can be disposed along the fold line of the center pocket if desired.

Referring to FIG. 9, a T-junction 106 is secured in the center of the pocket 48 by a suitable fastening clasp 108 attaching it to the cap cover. A set of ear buds 109, 110 is connected by leads 112, 114 respectively to the T-junction, and from there via the common lead segment 116 to a stereo jack 118. The common segment is long enough to allow a user to view and manipulate the controls of an audio device 120 when a user is wearing the cap with ear buds in place. Rather than a spring loaded retractor as described in my U.S. Pat. No. 7,702,122, the common segment 116 is simply wrapped around the audio device or otherwise gathered into the pocket 48 as it is replaced after manipulating the controls. The closure member 100 is then used to securely hold the audio device against being accidentally dislodged.

A number of alternate closure members (not shown) may be substituted for means to retain the audio device in pocket 48, such as snaps, buttons, tie cords, a description of these well-known closure devices not being deemed necessary for those skilled in the art.

While there is shown what is considered to be the preferred embodiment, along with a modification of the invention, other modifications will become apparent to those skilled in the art. It is intended to include within the scope of the appended claims all such modifications as fall within the true spirit and scope of the invention.

The invention claimed is:

1. Headgear adapted for docking and listening to an audio device by means of ear buds, said headgear comprising:

a cap having a back, opposite sides and a front, said cap comprising a headband and a cap cover attached to said headband, at least part of said headband being circumferentially stretchable to adjust to the head size of a user, a stretchable fabric member symmetrically disposed to cover portions of the cap cover on the back and opposite sides of the cap, said fabric member having a lower edge extending substantially halfway around the headband and sewn to the headband at a headband seam so as to allow the headband and fabric member to stretch circumferentially together, a first pocket seam and a second pocket seam attaching the fabric member to the cap cover, said first pocket seam defining a first bud pocket and a center pocket and said second pocket seam defining the center pocket and a second bud pocket, said center pocket having an open top arranged to receive an audio device, said first and second pocket seams extending from the open top of the center pocket toward the headband seam but stopping short of the headband seam to define a first and second passage between the fabric member and the cap cover connecting the center pocket with each of said first and second bud pockets, respectively, a first side seam extends from the first pocket seam to a first bud pocket opening in said first bud pocket and a second side seam extends from the second pocket seam to a second bud pocket opening in said second bud pocket, and an ear bud assembly comprising a stereo jack, first and second ear buds removably disposed respectively in said first and second bud pockets, and wiring electrically connecting the stereo jack to each of the ear buds, said wiring being bifurcated at a junction from a common segment into first and second segments, said first segment passing through said first passage from said center pocket to the first ear bud and of sufficient length to allow the first ear bud to exit the first bud pocket opening and enter the ear of a user wearing the cap, said second segment passing through said second passage from said center pocket to the second ear bud and of sufficient length to allow the second ear bud to exit the second bud pocket opening and enter the other ear of a user wearing the cap.

2. The headgear according to claim 1, wherein the stretchable fabric member is uniaxially stretchable with its axis of stretch directed along the headband.

* * * * *